US007728773B2

(12) United States Patent
Oh et al.

(10) Patent No.: US 7,728,773 B2
(45) Date of Patent: Jun. 1, 2010

(54) MULTI-BAND ANTENNA

(75) Inventors: Sae-Won Oh, Incheon (KR); Seung-Yong Lee, Pucheon-si (KR)

(73) Assignee: Ace Antenna Corp., Incheon (KR)

( * ) Notice: Subject to any disclaimer, the term of this patent is extended or adjusted under 35 U.S.C. 154(b) by 186 days.

(21) Appl. No.: 12/090,045

(22) PCT Filed: Oct. 11, 2006

(86) PCT No.: PCT/KR2006/004083

§ 371 (c)(1),
(2), (4) Date: Apr. 11, 2008

(87) PCT Pub. No.: WO2007/043800

PCT Pub. Date: Apr. 19, 2007

(65) Prior Publication Data

US 2008/0252532 A1 Oct. 16, 2008

(30) Foreign Application Priority Data

Oct. 11, 2005 (KR) ..... 10-2005-0095578
Oct. 11, 2005 (KR) ..... 10-2005-0095583

(51) Int. Cl.
*H01Q 1/38* (2006.01)

(52) U.S. Cl. ..... 343/700 MS

(58) Field of Classification Search ..... 343/700 MS
See application file for complete search history.

(56) References Cited

U.S. PATENT DOCUMENTS 4,021,810 A * 5/1977 Urpo et al. ..... 343/731
6,512,493 B2 * 1/2003 Park et al. ..... 343/895
6,822,609 B2 * 11/2004 Mendolia et al. ..... 343/700 MS
7,095,372 B2 * 8/2006 Soler Castany et al. ..... 343/700 MS
7,518,554 B2 * 4/2009 Bateman et al. ..... 343/700 MS

FOREIGN PATENT DOCUMENTS

| | | |
|---|---|---|
| EP | 1372213 | 12/2003 |
| KR | 1020040095689 | 11/2004 |
| WO | WO 02/065582 | 8/2002 |

OTHER PUBLICATIONS

International Search Report for PCT/KR2006/004083, mailed Jan. 18, 2007.

* cited by examiner

*Primary Examiner*—Tho G Phan
(74) *Attorney, Agent, or Firm*—LRK Patent Law Firm

(57) ABSTRACT

The present invention relates to a multi-band antenna and, more particularly, to a sub multi-band antenna, in which a planer conducting part, which has a plurality of protruding portions, is inserted into a depression, which is formed on the surface of a body part formed through injection molding using a mold having a specific shape to surround first and second wire members, and the fitting depression of a fastening part, which is formed through the cutting or die casting of a metal material, and to a sub-band built-in chip antenna, in which sub radiation patterns having a predetermined length are formed on the interior surface of a body part, which is formed through injection molding using a dielectric material or is formed of a layered substrate a dielectric material.

13 Claims, 8 Drawing Sheets

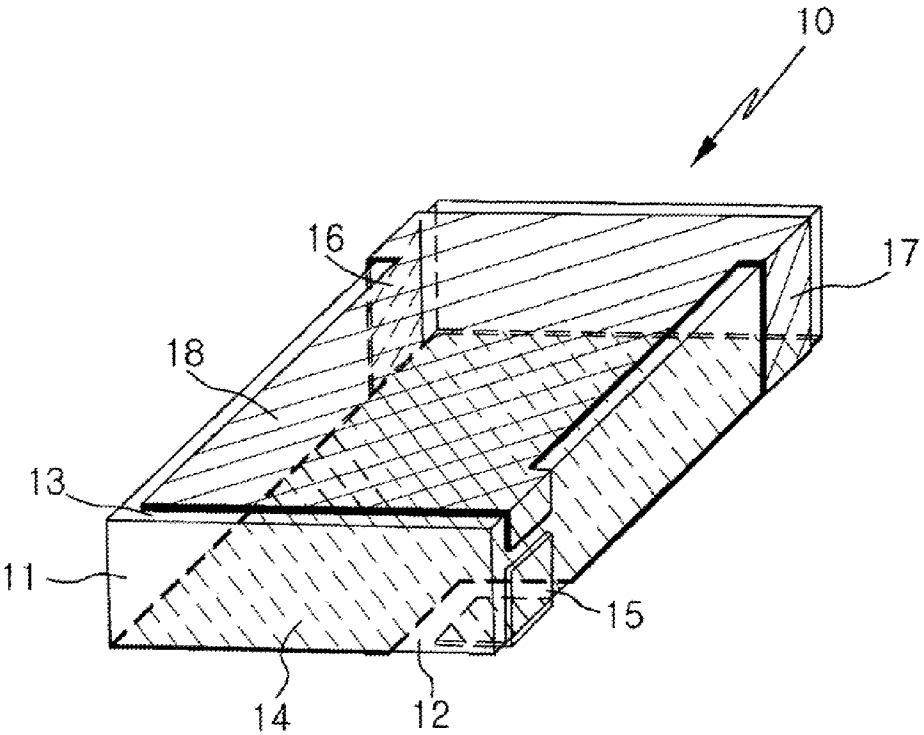
PRIOR ART
[Fig 1]

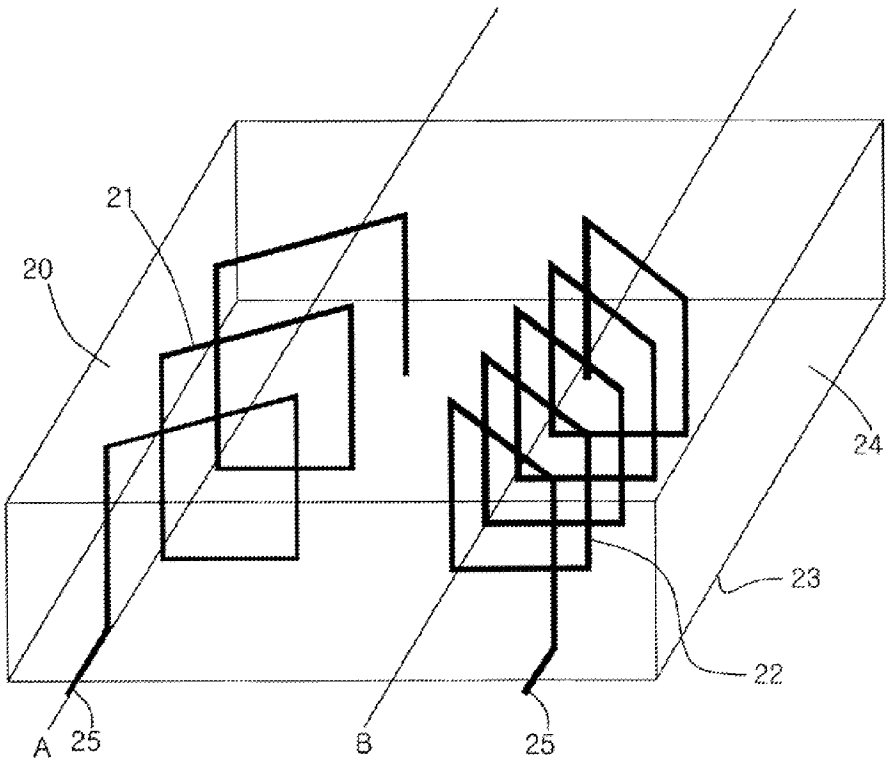
PRIOR ART
[Fig 2]

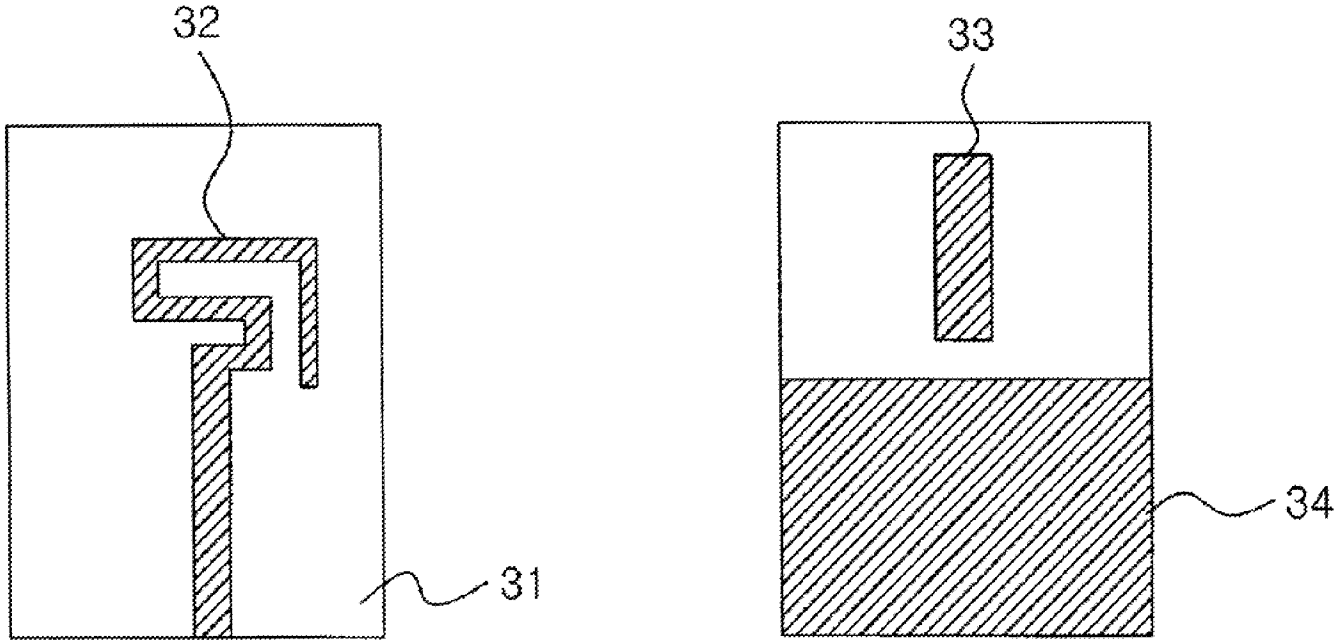
PRIOR ART
[Fig 3]

[Fig 4]
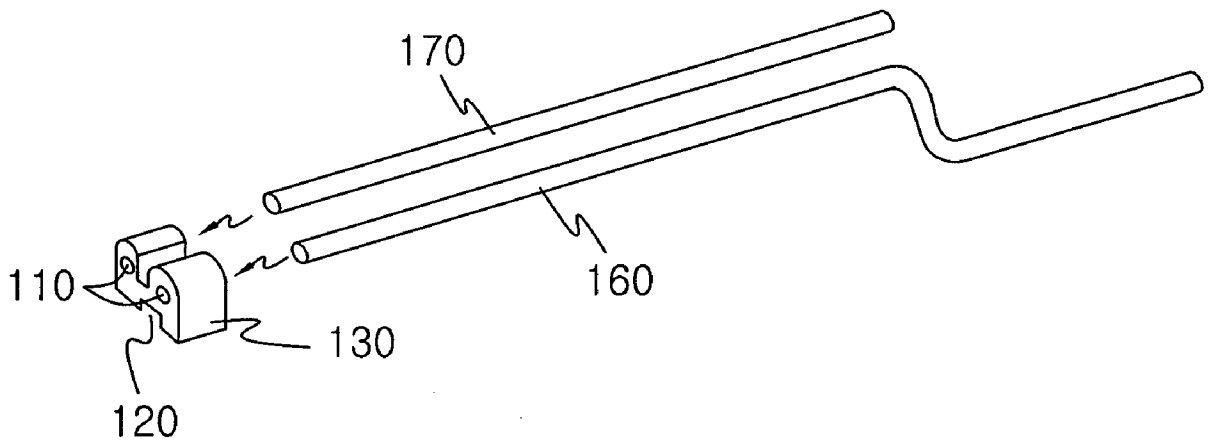

[Fig 5]
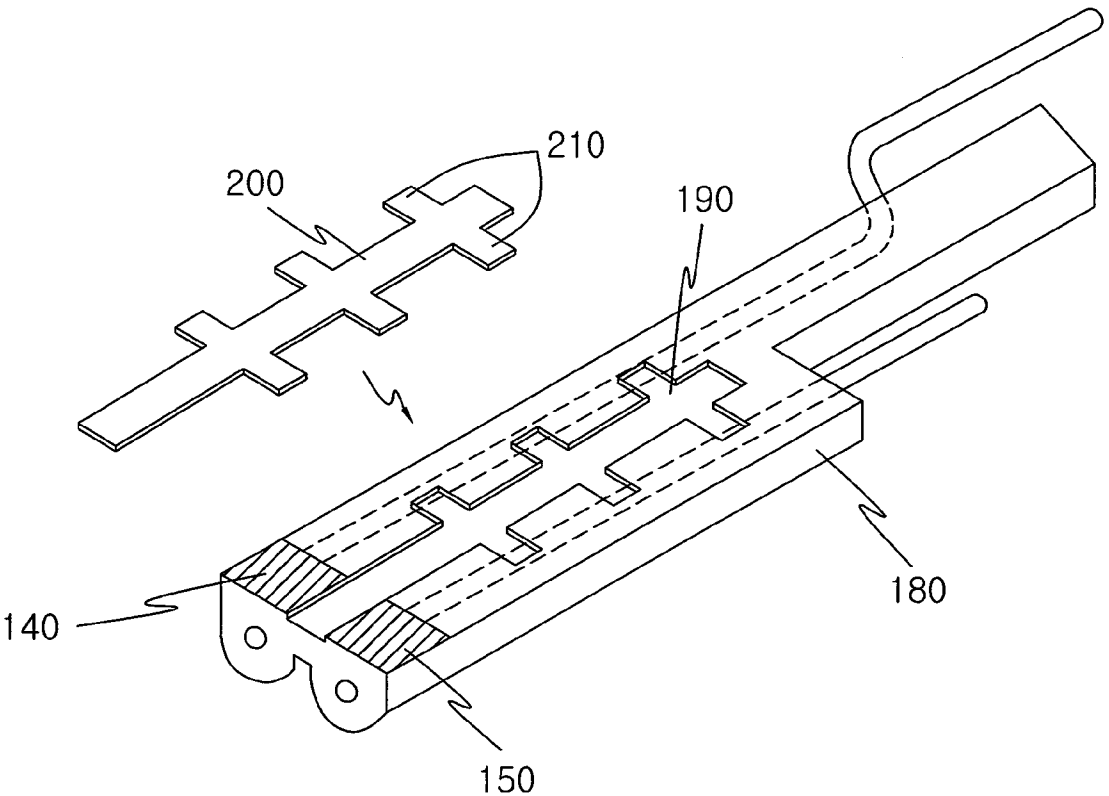

[Fig 6]
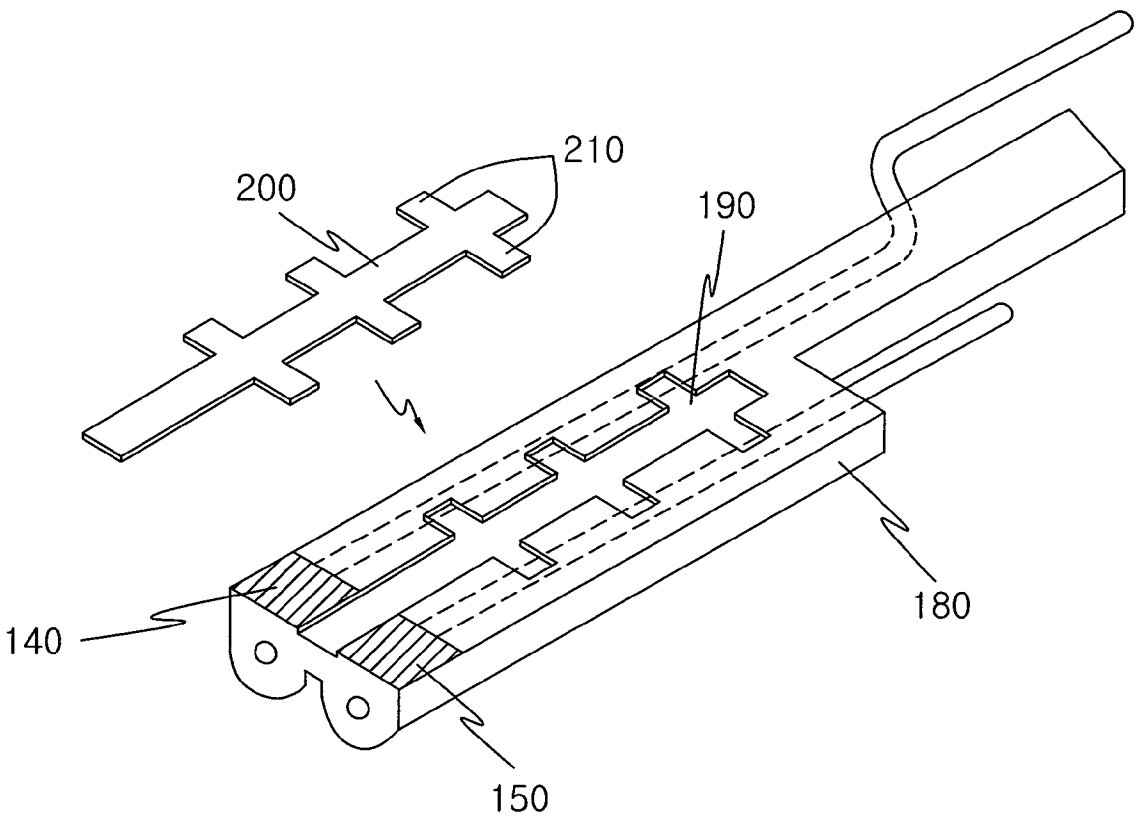

[Fig 7]
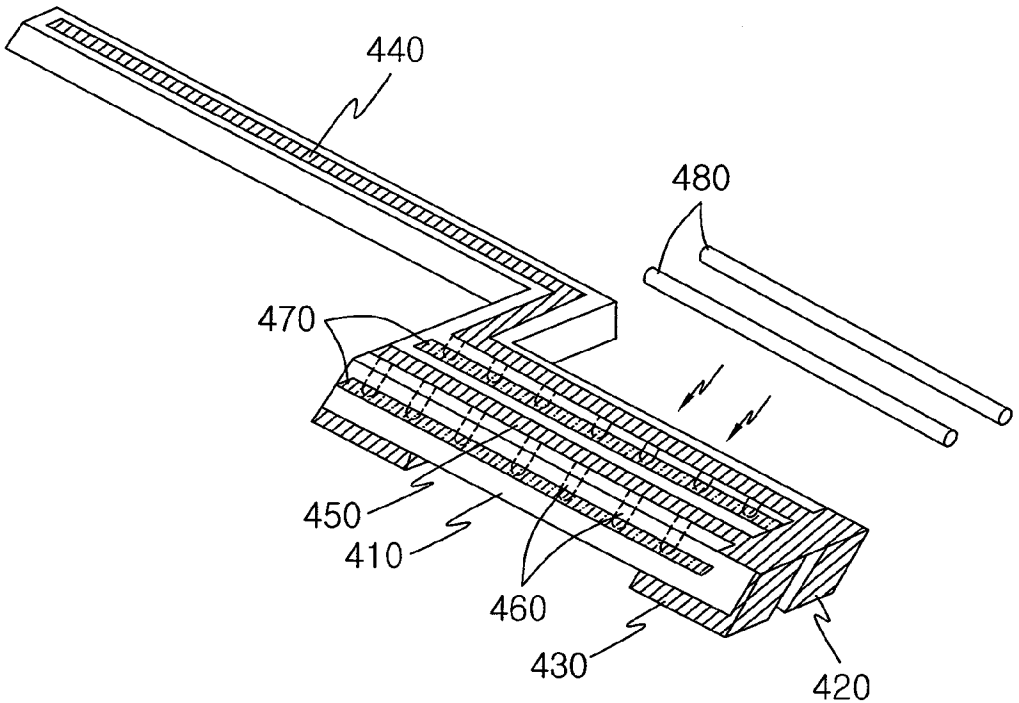

[Fig 8]
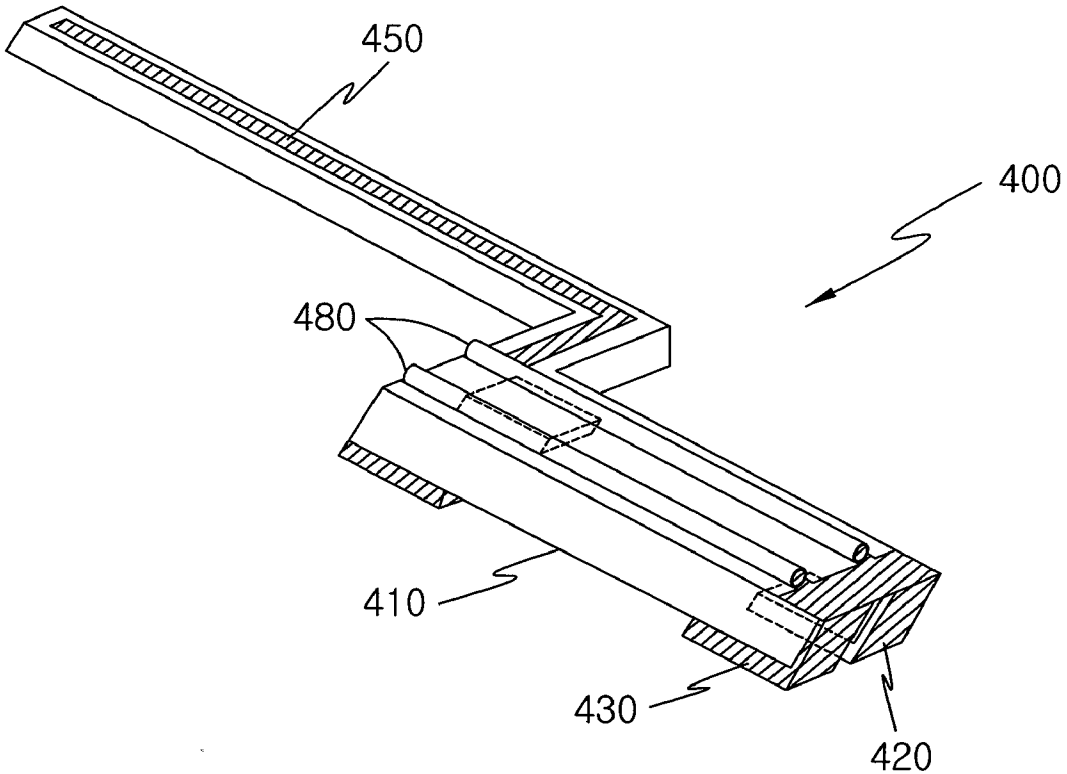

MULTI-BAND ANTENNA

TECHNICAL FIELD

The present invention relates to a multi-band antenna and, more particularly, to a sub multi-band antenna, in which a planer conducting part, which has a plurality of protruding portions, is inserted into a depression, which is formed on the surface of a body part formed through injection molding using a mold having a specific shape to surround first and second wire members, and the fitting depression of a fastening part, which is formed through the cutting or die casting of a metal material, thus increasing the number of resonance frequency bands, and in which the respective portions of the first and second wire members protrude outside the body part in the longitudinal direction of the body part, thus realizing excellent radiation patterns and being useable in a plurality of resonant frequency bands, and to a sub-band built-in chip antenna, in which sub radiation patterns having a predetermined length are formed on the interior surface of a body part, which is formed through injection molding using a dielectric material or is formed of a layered substrate a dielectric material, thus increasing the number of resonance frequency bands, and therefore obtaining a plurality of resonance frequency bands, and in which the amount of current flowing through the antenna patterns is increased by the wire members that are disposed on and connected with the antenna patterns, thus achieving excellent gain and radiation characteristics of the antenna.

BACKGROUND ART

FIG. 1 is a view showing the construction of a conventional surface-mount chip antenna 10.

As shown in FIG. 1, the conventional surface-mount chip antenna 10 includes a dielectric block 11 made of ceramic material or resin. The dielectric block 21 includes a ground electrode 14 formed on the first surface 12 thereof, a radiation electrode 18 formed on the second surface 13 thereof, and a feeding pattern 15 formed in a from a portion of the first surface 12 of the dielectric block 11 to a portion of one side of the dielectric block 11. The radiation electrode 18 is spaced apart from the feeding pattern 15 by a certain distance and is connected to the ground electrode 14 via two short circuit portions 16 and 17 that are respectively formed on two sides of the dielectric block 11. Furthermore, the radiation electrode 18 has a length of $\lambda/4$ at a resonance frequency.

The surface-mount chip antenna 10 described above forms a resonance circuit using capacitance between the ground electrode 14 and the radiation electrode 18 and the inductance of the radiation electrode 18, and adjusts the resonance frequency by coupling the radiation electrode 18 with the feeding pattern 15 using the capacitance between the feeding pattern 15 and the radiation electrode 18. However, there is a problem in that it is difficult to provide multi-frequency band communication service because an electrode appropriate to a specific resonance frequency is formed through a certain pattern-forming process and is then used for only a single frequency band composed of one usable frequency band.

FIG. 2 is a view showing the construction of a conventional ceramic chip antenna.

As shown in FIG. 2, the conventional ceramic chip antenna includes a chip main body 20 formed by stacking a plurality of green sheets, which are made of a ceramic dielectric material, a first helical conductor 21 formed in the chip main body 20 in a helical form, and a second helical conductor 22 disposed in parallel with the first helical conductor 21 in the chip main body 20 and formed in a helical form. The first helical conductor 21 is formed using a plurality of horizontal and vertical strip lines in a helical form, and the helical rotational axis A of the first helical conductor 21 is parallel to the bottom and side surfaces 23 and 24 of the chip main body 20 made of ceramic. In the same manner, the second helical conductor 22 is formed using a plurality of horizontal and vertical strip lines in a helical form, and the helical rotational axis B of the second helical conductor 22 is parallel to the bottom and side surfaces 23 and 24 of the chip main body 20.

In this case, the first and second helical conductors 21 and 22 are independently formed without being connected to each other, the helical rotational axes A and B of the conductors 21 and 22 are parallel to each other, and the strip lines and the via holes in the respective green sheets are three-dimensionally connected to each other through precise alignment so that the first and second helical conductors 21 and 22 are formed.

Furthermore, voltage supply terminals 25 are formed at respective ends of the helical conductors 21 and 22 protruding outside the main body 20. In this case, if voltage is applied to the helical conductors 21 and 22 through the voltage supply terminals 25, a problem occurs in that the helical conductors 21 and 22 resonate in two different frequency bands.

Although the conventional ceramic chip antenna described above has recently been developed to a level at which it is possible to contain the antenna in a mobile terminal in the form of a small-sized chip, there are problems in that the characteristics of the antenna vary due to sensitivity to external environment factors and it is difficult to provide multiple frequency band radio communication service.

FIG. 3 is a view showing the construction of a conventional wireless Local Network Area (LAN) multi-band antenna.

The wireless LAN multi-band antenna is based on a well-known technology for reducing the size of an antenna, and employs a meander line.

As shown in FIG. 3, a portion of the upper surface of an insulating substrate is patterned to be formed in the shape of a meander line 32. In this case, a resonance frequency is determined according to the length of the meander line 32. That is, resonance occurs at a lower frequency as the length of the meander line 32 increases. The meander line 32 is designed to correspond to a first frequency range.

A portion of the lower surface of the insulating substrate 31 is patterned to be used as a ground 34, and thus resonance is induced at a third frequency band (that is, a frequency band of 5.8 GHz). In this case, the values of a frequency bandwidth and a resonance frequency vary with the area of the partial ground 34, that is, the length and size of the partial ground 34. When the area of the partial ground increases, the resonance occurs at a relatively low frequency. In contrast, when the area of the partial ground decreases, the resonance occurs at a relatively high frequency. A dual band (2.4 GHz and 5.8 GHz) is realized using the meander line 32 and the partial ground 34 as described above, a back microstrip line 33 is attached above the partial ground 34 to increase the frequency bandwidth, and thus a broadband accommodating a second frequency (5.2 GHz) and the third frequency (5.8 GHz) is formed.

Although the conventional wireless LAN multi-band antenna described above is manufactured such that it can be provided in a mobile communication terminal, the amount of current flowing through the meander line and the back microstrip line is limited, so that problems occur in that the gain and radiation characteristics of the antenna are degraded.

DISCLOSURE

Technical Problem

Accordingly, the present invention has been made keeping in mind the above problems occurring in the prior art, and an object of the present invention is to provide a sub multi-band antenna, in which a planer conducting part, which has a plurality of protruding portions, is inserted into a depression, which is formed on the surface of a body part formed through injection molding using a mold having a specific shape to surround first and second wire members, and the fitting depression of a fastening part, which is formed through the cutting or die casting of a metal material, thus increasing the number of resonance frequency bands, and in which the respective portions of the first and second wire members protrude outside the body part in the longitudinal direction of the body part, thus realizing excellent radiation patterns and being useable in a plurality of resonance frequency bands.

Another object of the present invention is to allow the wavelengths of resonance frequencies to be reduced by injection molding using a dielectric material, so that the size of the antenna can be reduced, and variation in the characteristics of the antenna due to external environment factors can be prevented.

A further object of the present invention is to provide a sub-band built-in chip antenna, in which a plurality of via holes are formed through the antenna patterns of a body part, which is formed through injection molding or is formed of a layered substrate, and sub radiation patterns having a predetermined length, which are connected to the via holes, are formed on the interior surface of the body part, thus increasing the number of resonance frequency bands is increased, and therefore obtaining a plurality of resonance frequency bands can be obtained, and in which the amount of current flowing through the antenna patterns is increased by the wire members disposed on antenna patterns and connected with the antenna patterns, thus achieving excellent gain and radiation characteristics of the antenna.

Technical Solution

In order to accomplish the above objects, an embodiment of the present invention is characterized in that it includes a fastening part formed through cutting or molding of a metal material and provided with two through-holes formed parallel with each other, and a fitting depression formed on the surface thereof to one side of a position between the through-holes; first and second wire members inserted into the two through-holes, respectively; a body part formed through injection molding using a mold having a specific shape to surround the first and second wire members and configured to have a depression on one side of the body part; and a conducting part inserted into the depression of the body part and the fitting depression of the fastening part; wherein portions of the first and second wire members protrude outside the body part in a longitudinal direction of the body part.

In accordance with an embodiment of the present invention, the fastening part includes a feeding part for feeding current and a ground part.

In accordance with an embodiment of the present invention, the first wire member is bent at an angle of 90 degrees and extended, and forms a low resonance frequency band depending on variation in the length thereof.

In accordance with an embodiment of the present invention, the second wire member is rectilinearly formed, and forms a high resonance frequency band depending on variation in the length thereof.

In accordance with an embodiment of the present invention, the respective protruded portions of the first and second wire members are adjusted in length, so that the resonance frequency bands of the first and second wire members are formed.

In accordance with an embodiment of the present invention, the conducting part is a planar conductor having a plurality of protruding portions, and thereby increases the number of resonance frequency bands.

Another embodiment of the present invention is characterized in that it includes a body part formed through injection molding using a dielectric material or formed of a layered substrate using a dielectric material; a feeding pattern and a ground pattern formed on the lower and side surfaces of one side of the body part; antenna patterns connected with the feeding pattern and formed on the upper surface of the body part; and wire members disposed on and connected to the antenna patterns, thereby increasing the amount of current through the antenna patterns.

In accordance with an embodiment of the present invention, the body part has a rectangular shape, a portion of one side of which is bent at an angle of 90 degrees and extended through injection molding.

In accordance with an embodiment of the present invention, the antenna patterns includes a first radiation pattern bent at an angle of 90 degrees and extended, and configured to form a low resonance frequency band depending on the length thereof; and a second radiation pattern rectilinearly formed parallel with the first radiation pattern, and configured to form a high resonance frequency band depending on the length thereof.

In accordance with an embodiment of the present invention, a plurality of via holes is formed through the first and second radiation patterns, and sub radiation patterns having a predetermined length, which are connected to the via hole, are formed on the interior surface of the body part.

In accordance with an embodiment of the present invention, the first and second radiation patterns are adjusted in length so that resonance frequency bands are formed.

Advantageous Effects

In the present invention, constructed as described above, a planar conducting part, which has a plurality of protruding portions, is inserted into a depression, which is formed on the surface of a body part formed through injection molding using a mold having a specific shape to surround first and second wire members, and the fitting depression of a fastening part, which is formed through the cutting or die casting of a metal material, so that the number of resonance frequency bands is increased. Furthermore, the first and second wires protrude outside the body part in the longitudinal direction of the body part, so that excellent radiation patterns and a plurality of resonance frequency bands can be achieved.

Furthermore, the antenna is formed through injection molding using a dielectric material, so that the wavelengths of resonance frequencies are reduced, therefore the size of the antenna can be reduced and variation in the characteristics of the antenna due to external environmental factors can be prevented.

Furthermore, in the present invention, a plurality of via holes is formed through the antenna patterns of the body part, which is formed through injection molding using a dielectric material or is formed of a layered substrate antenna using a dielectric material, and sub radiation patterns having a predetermined length, which are connected to the via holes, are formed on the interior surface of the body part, so that the number of resonance frequency bands is increased and, therefore, a plurality of resonance frequency bands can be obtained. Furthermore, the amount of current flowing through the antenna patterns is increased by the wire members disposed on and connected with the antenna patterns, so that excellent gain and radiation characteristics of the antenna can be achieved.

DESCRIPTION OF DRAWINGS

FIG. 1 is a view showing the construction of a conventional surface-mount chip antenna;

FIG. 2 is a view showing the construction of a conventional ceramic chip antenna;

FIG. 3 is a view showing the construction of a conventional wireless LAN multi-band antenna;

FIG. 4 is an assembly view of the first and second wires of a sub multi-band chip antenna according to an embodiment of the present invention;

FIG. 5 is an assembly view of the conductor part of the sub multi-band chip antenna according to an embodiment of the present invention;

FIG. 6 is a view showing the construction of the sub multi-band chip antenna according to an embodiment of the present invention;

FIG. 7 is an assembly view of a sub-band built-in chip antenna according to an embodiment of the present invention; and FIG. 8 is a view showing the construction of the sub-band built-in chip antenna according to the embodiment of the present invention.

BEST MODE

FIG. 4 is an assembly view of the first and second wires of a sub multi-band chip antenna 100 according to an embodiment of the present invention, and FIG. 5 is an assembly view of the conductor part of the sub multi-band chip antenna 100 according to an embodiment of the present invention.

As shown in FIGS. 4 and 5, the sub multi-band antenna 100 includes two through-holes 110 formed parallel to each other, a fastening part 130 configured to have a fitting depression 120 formed on the surface of the fastening part 130 to one side of a position between the through-holes 110, a first wire member 160 and a second wire member inserted into the two through-holes 110, respectively, a conducting part 200 inserted into the fitting depression 120, and a body part 180 configured to have a depression 190 formed on one side surface of the body part 180 such that the conducting part 200 can be inserted into the depression 190, and formed through injection molding using a mold having a specific shape to surround the first and second wire members 160 and 170 and cause a portion of the body part 180 to protrude.

The fastening part 130 is formed such that the two through-holes 110 are arranged parallel to each other by cutting or molding a metal material, has the fitting depression 120 formed on the surface of the fastening part 130 to one side of a position between the through-holes 110, and is formed such that a feeding part 140 for feeding current and a ground part 150 are surface-mounted to the body part 180.

The first wire 160 is bent at an angle of 90 degrees and extended, is formed to have a length of $\lambda/4$, corresponding to the center frequency of a resonance frequency band (2.3 GHz~2.6 GHz), and is inserted into one of the through-holes 110 of the fastening part 130.

The second wire 170 is rectilinearly formed to have a length of $\lambda/4$, corresponding to the center frequency of a high resonance frequency band (5.2 GHz~5.8 GHz), and is inserted into the other of the through-holes 110 of the fastening part 130.

The body part 180 is formed of a dielectric material through injection molding using a rectangular-shaped mold, an edge portion of one side of which is bent at an angle of 90 degrees and is extended, so as to allow the first wire member 160 and the second wire member 170 to be inserted into the respective through-holes 110 of the fastening part 130 and surround the first wire member 160 and the second wire member 170 from the fastening part 130. The portions of the first wire 160 and the second wire 170 protrude outside the body part 180, and the depression 190 is formed on a surface of the body part 180. Furthermore, the length of each of the protruded portions of the first wire member 160 and the second wire member 170 is adjustable, and thus resonance frequency bands are formed.

The conducting part 200 is a planer conductor having a plurality of protruding portions, is inserted into the depression 190, which is formed on the body part 180, and the fitting depression 120 of the fastening part 130, and functions to increase the resonance frequency bandwidth through electrical connection between the first wire member 160 and the second wire member 170.

FIG. 6 is a view showing the construction of the sub multi-band chip antenna 100 according to an embodiment of the present invention.

As shown in FIG. 6, the sub multi-band antenna 100 is configured such that the planar conducting part 200, having a plurality of protruding portions 210, is inserted into the depression 190 of the body part 180 and the fitting depression 120 of the fastening part 130, the body part 180 being formed of a dielectric material through injection molding using a rectangular-shaped mold, an edge portion of one side of which is bent at an angle of 90 degrees and is extended, so as to allow the first wire 160, which is bent at an angle of 90 degrees and extended and is formed to have a length of $\lambda/4$, corresponding to the center frequency of a resonance frequency band (2.3 GHz~2.6 GHz), and the second wire 170, which is rectilinearly formed to have a length of $\lambda/4$, corresponding to the center frequency of a high resonance frequency band (5.2 GHz~5.8 GHz), to be respectively inserted into the two through-holes 110 formed in the fastening part 130, surround the first wire 160 and the second wire 170 from the fastening part 130, and allow an end portion of the body part 180 to protrude, and thus allowing current to be fed through the feeding part 140, therefore performing a function of increasing the resonance frequency bandwidth and forming excellent radiation patterns and a plurality of resonance frequency bands due to the first and second wire members 160 and 170 which protrude outside the body part 180.

FIG. 7 is an assembly view of a sub-band built-in chip antenna according to an embodiment of the present invention, and FIG. 8 is a view showing the construction of the sub-band built-in chip antenna according to an embodiment of the present invention.

As shown in FIGS. 7 and 8, a body part 410 is formed of a dielectric material through injection molding using a rectangular-shaped mold, an edge portion of one side of which is bent at an angle of 90 degrees and is extended. Antenna patterns are formed on the upper surface of the body part 410 through an electroplating process.

A feeding pattern 420 is extended from the lower surface of a side of the body part 410 to the side surface thereof in a surface-mount manner, and is fed with current through a portion opposite the bent and extended portion thereof. A ground pattern 430 is formed parallel to the feeding pattern 420 from the lower surface of an opposite side of the body part 410 to the side surface thereof. Two rectangular patterns for surface mounting are formed on one side of the banded and extended portion of the feeding pattern 420.

The antenna patterns are connected with the feeding pattern 420 and the ground pattern formed on the side surface of the body part 410. A first radiation pattern 440 is formed as a linear circuit pattern having a length of λ/4, corresponding to the center frequency of a low resonance frequency band (2.3 GHz~2.6 GHz), and is bent at an angle of 90 degrees on the upper surface of the body part 410. A resonance frequency band is adjusted depending on variation in the length of the first radiation pattern 440. The resonance frequency band of a second radiation pattern 450, which is formed parallel to the first radiation pattern 440 and has a linear length of λ/4, corresponding to the center frequency of a high resonance frequency band (5.2 GHz~5.8 GHz), is adjusted depending on variation in the length of the second radiation pattern 450. A plurality of via holes 460 is formed through the radiation patterns 440 and 450, and sub radiation patterns, having a length corresponding to a desired resonance frequency band 470, are formed on the interior surface of the body part 410 and are connected with the first and second radiation patterns 440 and 450 through the via holes 460.

The wire member 480 has a predetermined linear length and is disposed on the first and second radiation patterns 440 and 450 so as to be connected to the first and second radiation patterns 440 and 450, so that it increases the amount of current flowing through the radiation patterns 440 and 450, thus improving the gain and radiation characteristics of the antenna.

The subband built-in chip antenna 400 is configured such that the first radiation pattern 440, which has a length of λ/4, corresponding to the center frequency of a low resonance frequency band (2.3 GHz~2.6 GHz) and is formed depending on the bent and extended shape, and the second radiation pattern 450, which is formed parallel to the first radiation pattern 440 and has a length of λ/4, corresponding to the center frequency of a high resonance frequency band (5.2 GHz~5.8 GHz), are formed on the upper surface of the body part 410, which is formed of a dielectric material through injection molding using a rectangular-shaped mold, an edge portion of one side of which is bent at an angle of 90 degrees and is extended. The plurality of via holes 460 is formed through the radiation patterns 440 and 450 and is connected with the sub radiation patterns 470, which have a length corresponding to a desired resonance frequency band and are formed on the interior surface of the body part 410, so that it allows current to be fed though the feeding pattern 420 formed on the lower surface of one side of the body part 410 to the side surface thereof, therefore performing a function of increasing the resonance frequency bandwidth.

Furthermore, the wire member 480 is disposed on the first and second radiation patterns 440 and 450 and is connected thereto, thus increasing the amount of current through the respective radiation patterns 440 and 450. Accordingly, excellent gain and radiation characteristics of the antenna can be achieved.

From the description above, it will be understood by those skilled in the art that the present invention may be modified and changed in various ways within a range that does not depart from the technical spirit of the present invention. Accordingly, the technical scope of the present invention should be defined by the accompanying claims, rather than defined by the detailed description of the specification.

The invention claimed is:

1. A multi-band antenna, comprising:

a fastening part formed through cutting or molding of a metal material and provided with two through-holes formed parallel with each other, and a fitting depression formed on a surface thereof to one side of a position between the through-holes;

first and second wire members inserted into the two through-holes, respectively;

a body part formed through injection molding using a mold having a specific shape to surround the first and second wire members and configured to have a depression on one side of the body part; and a conducting part inserted into the depression of the body part and the fitting depression of the fastening part;

wherein portions of the first and second wire members protrude outside the body part in a longitudinal direction of the body part.

2. The multi-band antenna according to claim 1, wherein the fastening part comprises a feeding part for feeding current and a ground part.

3. The multi-band antenna according to claim 2, wherein the fastening part is a surface-mount fastening part.

4. The multi-band antenna according to claim 1, wherein the first wire member is bent at an angle of 90 degrees and extended, and forms a low resonance frequency band depending on variation in a length thereof.

5. The multi-band antenna according to claim 1, wherein the second wire member is rectilinearly formed, and forms a high resonance frequency band depending on variation in a length thereof.

6. The multi-band antenna according to claim 4 or 5, wherein the respective protruded portions of the first and second wire members are adjusted in length, so that resonance frequency bands of the first and second wire members are formed.

7. The multi-band antenna according to claim 1, wherein the conducting part is a planar conductor having a plurality of protruding portions, and thereby increases a number of resonance frequency bands.

8. The multi-band antenna according to claim 1, wherein the body part has a rectangular shape, a portion of one side of which is bent at an angle of 90 degrees and extended through injection molding.

9. A multi-band antenna, comprising:

a body part formed through injection molding using a dielectric material or formed of a layered substrate using a dielectric material;

a feeding pattern and a ground pattern formed on lower and side surfaces of one side of the body part;

antenna patterns connected with the feeding pattern and formed on an upper surface of the body part; and wire members disposed on and connected to the antenna patterns, thereby increasing an amount of current through the antenna patterns.

10. The multi-band antenna according to claim 9, wherein the body part has a rectangular shape, a portion of one side of which is bent at an angle of 90 degrees and extended through injection molding.

11. The multi-band antenna according to claim 9, wherein the antenna patterns comprise;

a first radiation pattern bent at an angle of 90 degrees and extended, and configured to form a low resonance frequency band depending on a length thereof; and a second radiation pattern rectilinearly formed parallel with the first radiation pattern, and configured to form a high resonance frequency band depending on a length thereof.

12. The multi-band antenna according to claim 11, wherein a plurality of via holes is formed through the first and second radiation patterns, and sub radiation patterns having a predetermined length, which are connected to the via hole, are formed on an interior surface of the body part.

13. The multi-band antenna according to claim 11, wherein the first and second radiation patterns are adjusted in length so that resonance frequency bands are formed.

* * * * *